US006059209A

United States Patent [19]

Barson

[11] Patent Number: 6,059,209

[45] Date of Patent: May 9, 2000

[54] MANUALLY OPERATED APPARATUS FOR CRUSHING TABLETS INTO POWDERS

[76] Inventor: John C. Barson, 974 E. 620 North, Provo, Utah 84601

[21] Appl. No.: 09/315,318

[22] Filed: May 20, 1999

Related U.S. Application Data

[60] Provisional application No. 60/086,334, May 21, 1998.

[51] Int. Cl.[7] ..... B02C 19/08

[52] U.S. Cl. ..... 241/168; 241/169.2; 241/DIG. 27

[58] Field of Search ..... 241/168, 169, 241/169.2, 100, DIG. 27, 262

[56] References Cited

U.S. PATENT DOCUMENTS

| | | | |
|---|---|---|---|
| 979,364 | 12/1910 | Baudement et al. | 241/169.2 |
| 2,046,396 | 7/1936 | Matter et al. | 241/169.2 |
| 2,334,806 | 11/1943 | Boylan | 83/12 |
| 3,915,393 | 10/1975 | Elkins | 241/168 |
| 4,003,523 | 1/1977 | Doolittle | 241/169.2 |
| 4,121,775 | 10/1978 | Roseberg et al. | 241/30 |
| 4,341,356 | 7/1982 | Hiott et al. | 241/169.2 |
| 4,582,265 | 4/1986 | Petronelli | 241/169.2 X |
| 4,694,996 | 9/1987 | Siegel | 241/169 X |
| 4,763,847 | 8/1988 | Vosburgh | 241/169 |
| 4,967,971 | 11/1990 | Smith | 241/169 |
| 5,025,996 | 6/1991 | Lavin et al. | 241/168 |
| 5,067,666 | 11/1991 | Sussman | 241/36 |
| 5,123,601 | 6/1992 | Lavin et al. | 241/168 |
| 5,148,995 | 9/1992 | Hurst | 241/30 |
| 5,178,337 | 1/1993 | Lupoli | 241/169 |
| 5,823,451 | 10/1998 | Sharpe | 241/169.2 |
| 5,915,637 | 6/1999 | Parsons | 241/168 |
| 5,924,636 | 7/1999 | Calderon | 241/169.2 X |

*Primary Examiner*—John M. Husar
*Attorney, Agent, or Firm*—Workman Nydegger Seeley

[57] ABSTRACT

A pill crusher with a pivotable hammer which applies pressure to the tablets when a press applies pressure to the hammer enables a user to quickly and securely crush tablets. The hammer and the press are pivotally connected to opposing ends of a body which has a crushing recess. Tablets are sandwiched between cups which are disposed in a crushing bowl. The crushing bowl is rotatably and removably located in the crushing recess. The hammer has a crushing head configured to be pivoted into the rotatable crushing bowl. The crushing head has a crushing surface configured with a pattern of alternating recessed portions and raised portions. The press is eccentrically connected and a lever extends eccentrically from the press.

49 Claims, 5 Drawing Sheets

MANUALLY OPERATED APPARATUS FOR CRUSHING TABLETS INTO POWDERS

This utility patent application claims priority to U.S. Provisional Patent Application Ser. No. 60/086,334, filed May 21, 1998, entitled MANUALLY OPERATED APPARATUS FOR CRUSHING TABLETS INTO POWDERS which was filed by John C. Barson. Ser. No. 60/086,334 is hereby incorporated by reference.

BACKGROUND OF THE INVENTION

1. The Field of the Invention

The present invention is related to an improved apparatus for crushing tablets into powders. More particularly, the apparatus is a pill crusher which enables dosed medicaments to be converted into powders which are more easily ingested by some patients.

2. The Relevant Technology

It has long been recognized that one of the preferred ways of administering medication is orally in tablet form. Medication in tablet form is the least expensive form in which to manufacture and package medication and is a preferred non-invasive delivery method. Further, compressed tablet form medication is the best form to avoid tampering.

There are several recognized problems associated with administering medication in tablet form. A principal known problem is that many children, geriatric patients, and mental patients have difficulty swallowing tablets. Additionally, a large number of people are subject to gag reflex response which will not permit them to swallow a tablet in solid form. A large number of bedridden patients or patients disposed in a reclined position are also not capable of swallowing tablets in solid form or in granular form. Persons or patients having to use nasalgastrological feeding tubes or other types of feeding tubes require that their medication be presented in a solution or liquid form. Medication has heretofore been taken in liquid form through a straw or in a powdered form when mixed with food. The above problems that exist with human patients also exist in the field of veterinary medicine.

An historical solution to the above mentioned problems of administering oral mediation in tablet form has been has been to grind the tablet through the use of a mortar and pestle. The use of a mortar and pestle, however, presents several problems. Use of a mortar and pestle is inefficient as each use requires cleaning and the crushing is relatively time intensive. Inadvertent spilling and crushed residue adhering to either the mortar or the pestle reduces the ultimate dosage transferred to the patient. Additionally, the manual grinding can cause the crushed tablets to produce inconsistent particle sizes as one individual may apply more pressure than another. It is also difficult to completely crush or fragment the tablets due to the considerable force required. Such a requirement of force often poses great difficulty for medical staff members, particularly when treating many patients.

To overcome the problems associated with the use of a mortar and pestle, various manual and motor driven devices were developed to grind, abrade, comminute compress fracture and/or crush tablets. Examples of mechanical crushers include those disclosed in U.S. Pat. No. 5,178.337, U.S. Pat. No. 5,148,995, U.S. Pat. No. 5,025,996, U.S. Pat. No. 4,341,356, U.S. Pat. No. 4,121,775, U.S. Pat. No. 3,915,393 and U.S. Pat. No. 2,334,806.

U.S. Pat. No. 3,915,393 provides for sandwiching a tablet between two paper pleated cup thereby avoiding cross-contamination and eliminating any need for cleaning the apparatus. However, the simple configuration of the apparatus results in uneven pressure being applied to the tablet. In the primary embodiment, the crusher head is located relatively close to the hinge of the apparatus in order to provide sufficient pressure to crush a tablet as a user pushes the lever. As a result, the crushed tablet is formed into a hardened wedge which is often harder than the pill was originally. This is particularly problematic when large quantities of pills need to be crushed for one patient as is frequently necessitated in nursing homes. The amount of time required to crush large numbers of pills poses a substantial problem for the staff responsible for crushing and dispensing medicaments to patients. Fully one half of the time spent on medication rounds is consumed crushing medication. Accordingly, during a "pill pass" with a duration of two hours, one hour is consumed preparing medications. Additionally, conventional crushers require significant effort from the operator.

Such a crushing apparatus also requires that the operator have significant strength, which some medical staff members do not possess. Some medical staff members compensate for their lack of strength by pounding the medication instead of squeezing it. This pounding, which is the most common misuse of crushing apparatuses, can result in the apparatus being damaged, patients being disturbed and damage to the surface on which the crushing apparatus is being used. It may also result in injuries to the user over extended periods of time.

In U.S. Pat. No. 3,915,393, the paper cups can be rotated to recrush the wedge as discussed at column 4, lines 26–43, however, the configuration of the surfaces pressing against the tablets repeatedly yields a wedge which flares in height in the direction away from the hinge. Accordingly, the tablet is not fragmented and is merely flattened to some extent. Further, rotating the tablets sandwiched between the cups while moving the crusher head up and down may result in the tablets being dislodged.

The tendency to form hardened wedges is diminished by moving the crusher head to a more central location as discussed at column 4, lines 48–62, however, the ability to apply pressure to the tablets is also thereby diminished. U.S. Pat. No. 3,915,393 also suggests at column 4, line 63 to column 5, line 2 that the crusher head be moved in a side-to-side motion. Such a side-to-side movement is generally undesirable as it may also result in dislodging the medication. It also frequently results in the tearing of the paper cups.

An example of a motor driven crusher is disclosed in U.S. Pat. No. 5,067,666. Motor driven crushers are relatively expensive and noisy. The noise can be a particular problem in some circumstances, such as in nursing homes or mental institutes. As discussed in U.S. Pat. No. 5,123,601 at column 2, lines 30–58, noise from loud crushing devices can disrupt a patient's sleep and tends to alarm patients with some form of dementia as well as some elderly patients. For nursing home residents with Alzheimer's Disease and such dementias, it is of utmost importance to keep a quiet atmosphere so that the patients are not agitated. Another problem associated with such motor driven crushers is that it is more difficult to apply an appropriate amount of pressure. When pressure is manually applied, the user can sense the amount of pressure need to fully crush the tablet.

It would be a significant improvement in the art to provide an apparatus for crushing pills or tablets which can fully fragment a pill as well as large quantities of tablets such as a paticnt's combined daily medication.

It would also be a significant improvement to provide an apparatus for crushing tablets which can efficiently crush tablets in significantly less time than is required by prior art crushing apparatus.

Additionally, it would be a significant improvement to provide an apparatus for crushing tablets which can crush tablets in a secure manner and which requires significantly less effort than prior art apparatuses such that there is no risk to the user through misuse of the apparatus and there is no risk of damage to the surface under the apparatus or the surrounding equipment.

Further, it would also be an improvement in the art to provide an apparatus for crushing tablets which prevents cross-contamination and is easily cleaned in the event of contamination.

Finally, it would be a significant improvement in the art to provide an apparatus for crushing tablets which is quiet, portable, and highly durable.

Accordingly, there is a need for an improved pill crusher that overcomes or avoid the above problems.

SUMMARY AND OBJECTS OF THE INVENTION

The present invention has been developed in response to the present state of the art and, in particular, in response to problems and needs that have not been fully or completely solved by currently available pill crushers.

Accordingly, it is an object of the present invention to provide a pill crusher that can fully fragment a tablet as well as large quantities of tablets such as a patient's combined daily medication.

It is also an object of the present invention to provide an apparatus for crushing tablets which can efficiently crush tablets in significantly less time, such as 75% less time, than is required by prior art crushing apparatus.

Additionally, it is an object of the present invention to provide an apparatus for crushing tablets which can crush tablets in a secure manner and which requires significantly less effort than prior art apparatuses such that there is no risk to the user through misuse of the apparatus and there is no risk of damage to the surface under the apparatus or the surrounding equipment.

Further, another object of the present invention is to provide an apparatus for crushing tablets which prevents cross-contamination and which is easily cleaned in the event of contamination.

Finally, it is also an object of the present invention to provide an apparatus for crushing tablets which is quiet, portable and highly durable.

A feature of the invention which enables the above identified objects to be achieved is a pivotable hammer which applies pressure to the tablets when a pivotable press applies pressure to the hammer. More specifically, the hammer and the press are pivotally connected to opposing ends of a body which include a hammer end and a press end.

The body has a crushing recess between the hammer end and the press end wherein tablets are placed for crushing. In the preferred embodiment, the tablets placed in the crushing recess are sandwiched between cups which are disposed in a rotatable crushing bowl. The crushing bowl is preferably removably located in the crushing recess.

The body may be a single integral component or several separate components such as a base connected to two support arms. The base and the support arms preferably rest on a support member. Additionally, the base is preferably attached to the support member.

The hammer has a bearing end opposite a pivot end which is pivotally connected to the hammer end of the body. The hammer is pivotable to a loading position to enable crushable tablets to be loaded into the crushing recess of the body. The hammer has a crushing head located between the pivot end and the bearing end of the hammer. The crushing head is configured for insertion into the crushing recess of the body when the hammer is pivoted into a contact position such the crushing head is in contact with crushable tablets placed in the crushing recess. As indicated hereinabove, the crushing head is also configured to be urged against the crushable tablets placed in the crushing recess to crush the tablets when sufficient pressure is applied by the press.

The press has a contact portion configured to press against the bearing end of the hammer when the hammer is in the contact position. The press is configured such that pivoting the press into a compression position enables the contact portion to be urged against the bearing end of the hammer. The press is also configured such that pivoting the press to a released position releases the hammer to pivot between the loading position and the contact position. The press is preferably eccentrically connected to the press end of the body such that the press pivots eccentrically.

A lever extends from the press to move the press between the released position and the compression position. The lever preferably extends eccentrically from the press, or more specifically, the lever preferably extends from an eccentric location near the perimeter of the press. Additionally, the lever preferably extends from the press at a location closer to the pivot axis of the press than the contact portion of the press.

Another feature of the invention which enables the above identified objects to be achieved is a crushing surface on the crushing head of the hammer configured with a pattern of alternating recessed portions and raised portions. The pattern is preferably a cross-shaped raised portion with raised arms and recessed portions between the arms.

these and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings listed hereinbelow.

FIG. 3 depicts the pivoting movement of the hammer and the press in phantom lines and clearly shows the eccentric pivot axis of press 90 and lever 100 extending eccentrically from press 90 in close proximity to the pivot axis.

DETAILED DESCRIPTION OF THE PREFERRED EMBODIMENTS

The present invention is directed to an improved apparatus for crushing tablets into powders. More particularly, the apparatus is a pill crusher which enables dosed medicaments to be converted into powders which are more easily ingested by some patients.

Figure 1:
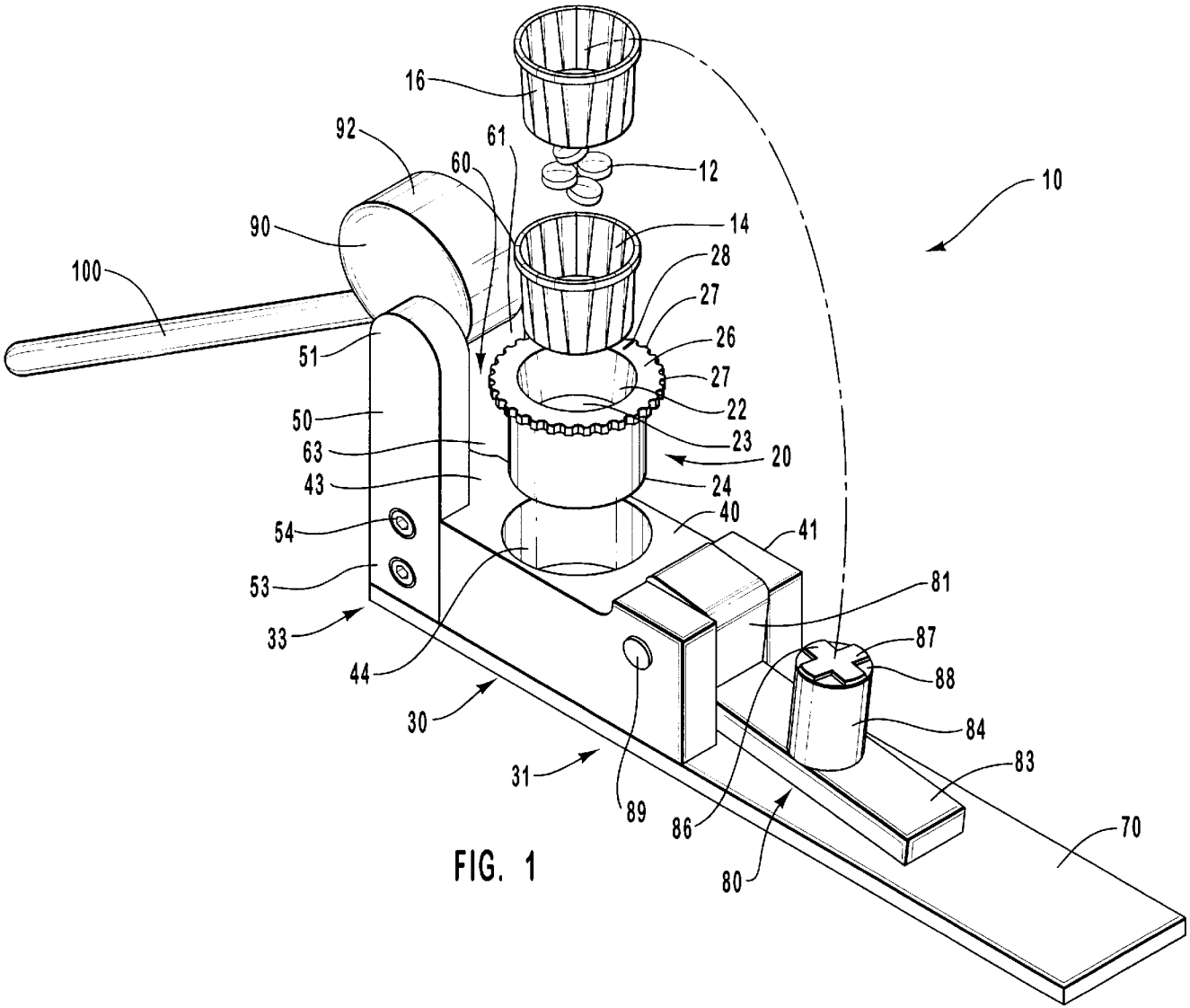
FIG. 1 is a perspective view of an apparatus of the present invention with an exploded perspective view of cups used to sandwich tablets in a crushing bowl. The hammer is pivoted to a loading or open position and the press is pivoted to a released or closed position.
Figure 2:
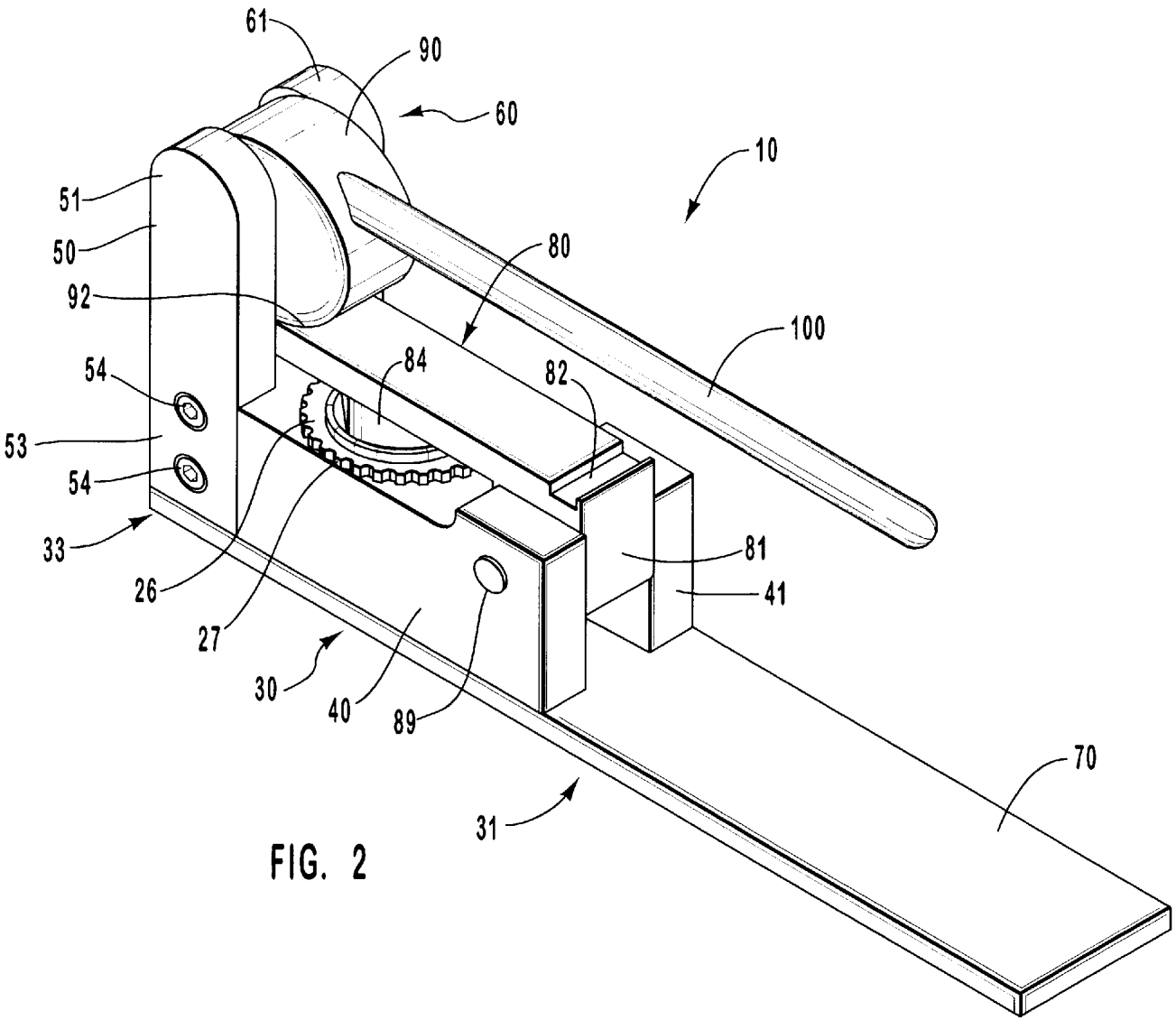
FIG. 2 is a perspective view of the apparatus shown in FIG. 1 with the hammer in a contact or closed position and the press in a compression or closed position.
Figure 3:
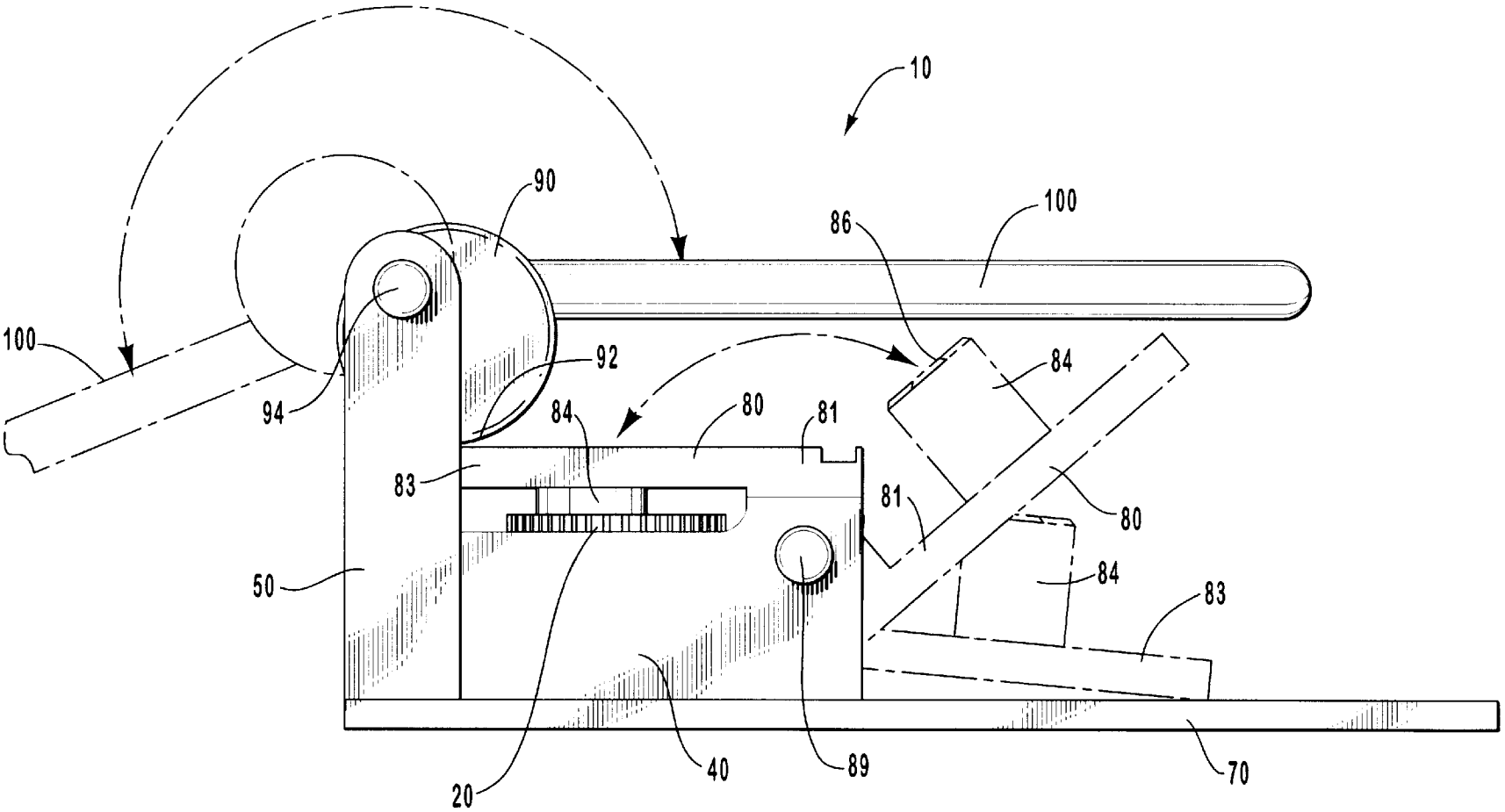
FIG. 3 is a side view of an apparatus which is essentially identical to the apparatus shown in FIGS. 1–2 except the apparatus shown in FIG. 3 is configured with a pin 94 extending through support arms 50 and 60.
Figure 4:
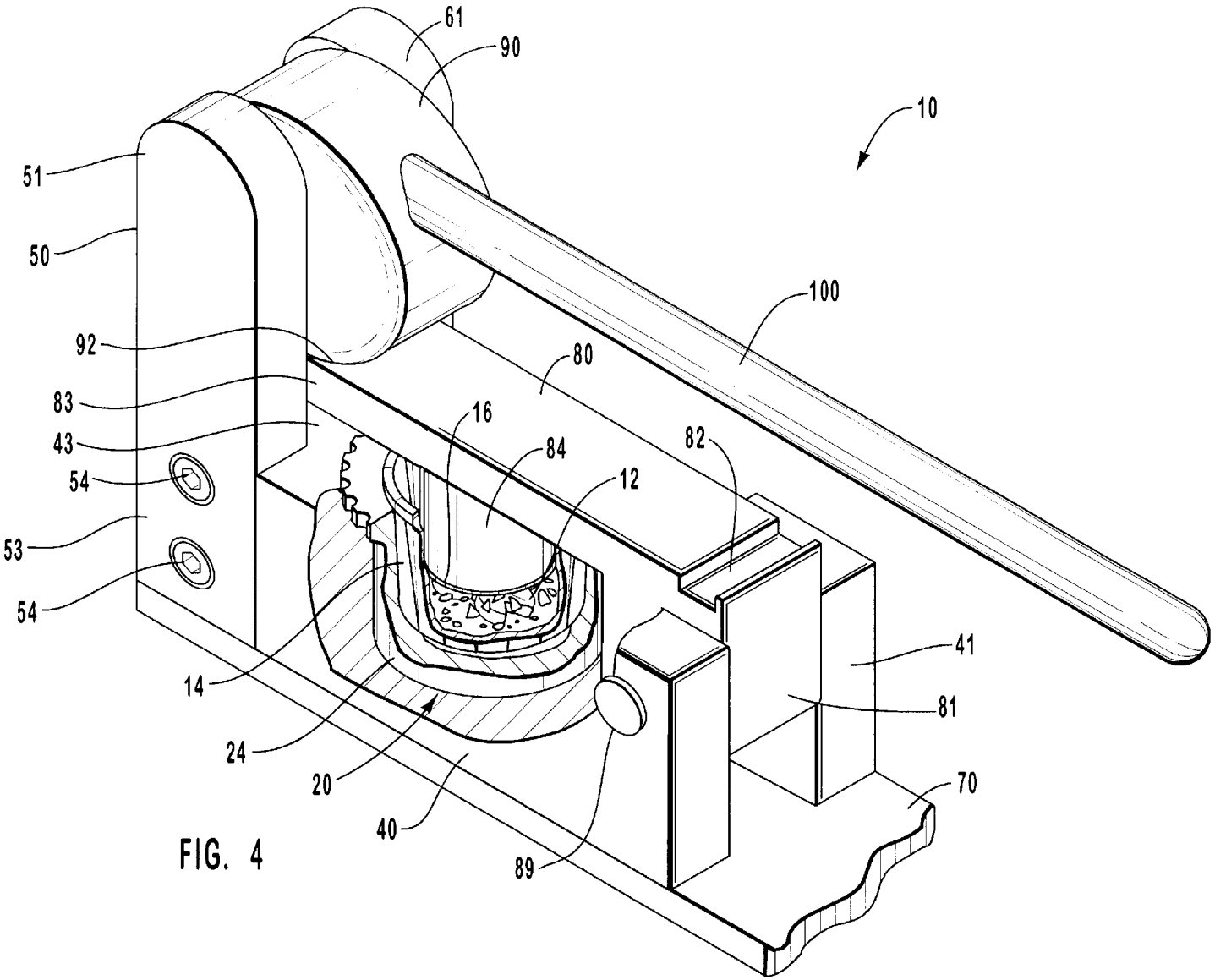
FIG. 4 is a perspective view of the apparatus as shown in FIG. 2 with a partial cut-away view.
Figure 5:
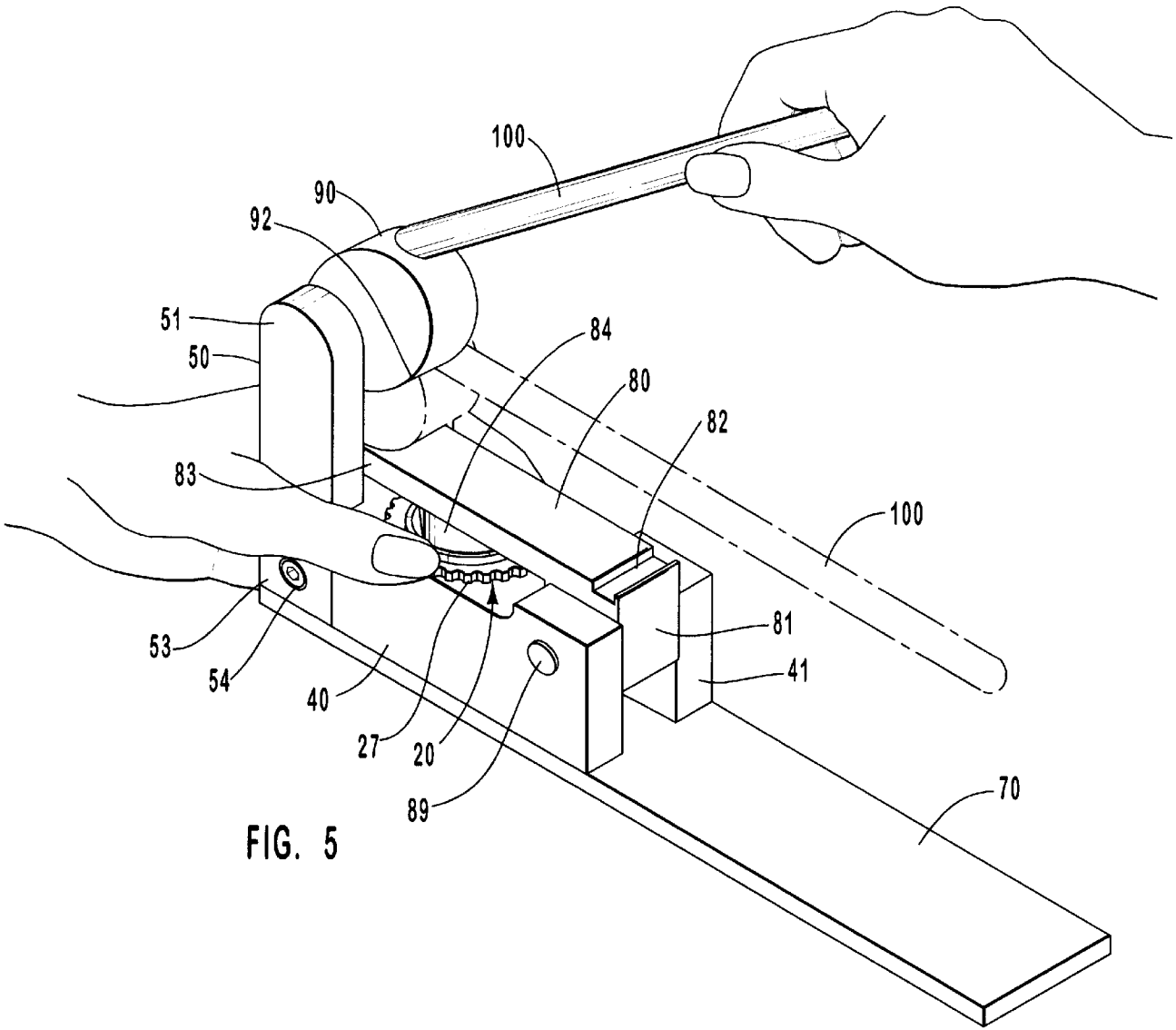
FIG. 5 is a perspective view of the apparatus is in use. A user is holding the apparatus such that one hand moves the lever while the user's other hand rotates the crushing bowl.

The main components of the apparatus shown in FIGS. 1–5 at 10 include a body 30, a hammer 80, a press 90 and a lever 100. FIG. 1 shows hammer 80 pivoted into a loading or open position and press 90 pivoted into a released or open position. After the medication is positioned for crushing, hammer 80 is pivoted into a contact or closed position as shown in FIGS. 2–5 and then press 90 is pivoted into a compression or closed position, as shown in FIGS. 2, 3 and 5. Hammer 80 is pivotally connected to hammer end 31 of body 30 while press 90 is pivotally connected to opposing press end 33 of body 30.

FIG. 1 shows an exploded perspective view of tablets or pills 12, a tablet cup 14, a crushing cup 16, and a crushing bowl 20. It is preferable for tablets 12 to be placed in a tablet or medication cup 14 and to then position a crushing cup 16 over tablets 12 to prevent contamination of the tablets. After tablets 12 are sandwiched between crushing cup 16 and tablet cup 14, it is also preferable to place the cups and tablets into a crushing bowl such as bowl 20. FIGS. 2–5 shows crushing bowl 20 positioned within a crushing recess 44 located between a hammer end 31 and a press end 33 of body 30.

Body 30 may be integral or formed from separate components as shown in FIGS. 1–5. The separate components of body 30 include a base 40, a left support arm 50, a right support arm 60 and an optional support member 70. Body 30 is an example of a body means for receiving crushable tablets.

Base 40 has a hammer end 41 opposite an attachment end 43. Attachment end 43 is configured for securing each of the two opposing support arms 50 and 60 in position. Each support arm 50 and 60 has a bottom end opposite a top end which are respectively 51 and 53 for the left arm and 61 and 63 for the right arm. The bottom ends 51 and 61 are attached to the attachment end 43 of base 40. Bottom ends 51 and 61 are preferably coupled to attachment end 43 of base in a male and female configuration as well as by bolts as shown at 54.

Base 40 is preferably connected to a support member as shown at 70 which stabilizes the apparatus 10. Support member 70 preferably has a length that is not less than the length of lever 100.

Hammer 80 has a pivot end 81 opposite a bearing end 83. Pivot end 81 of hammer 80 is pivotally connected to hammer end 31 of body 30 such that hammer 80 can be moved between a loading position and a contact position. More specifically, pivot end 81 is pivotally connected to hammer end 41 of base 40. Hammer 80 also has a thumb pull shown at 82. Thumb pull 82 is a recess configured to enable a user to flip hammer 82 upward into the loading position. The thumb pull can have many other suitable configurations such as a knob extending from hammer 80.

Hammer 80 has a crushing head 84 located between pivot end 81 and bearing end 83. Crushing head 84 is preferably centrally located between pivot end 81 and bearing end 83. Crushing head 84 is configured for insertion into crushing recess 44 when hammer 80 is moved into the contact position such that crushing head 84 can be urged against crushable tablets 12 placed in crushing recess 44 to crush tablets 12 when sufficient pressure is applied. Hammer 80 is an example of a hammer means for crushing tablets.

As previously indicated, tablets 12 are preferably sandwiched between tablet cup 14 and crushing cup 16 and then placed in crushing bowl 20. However, tablets may also be crushed directly in crushing recess 44 without a crushing bowl 20, tablet cup 14 or crushing cup 16. Such direct crushing, however, does not utilize several advantageous features of apparatus 10. The ability to utilize removable crushing bowl 20 enables a user to very easily clean the portion of apparatus 10 most likely to be contaminated. Additionally, utilizing conventional pleated paper cups to sandwich the tablets substantially minimizes the potential for contamination.

Crushing bowl 20 has an internal surface 22 configured to receive crushing head 84 and an external surface 24 configured to enable crushing bowl 20 to be inserted into crushing recess 44. External surface 24 and crushing recess 44 are preferably both configured to enable a user to rotate crushing bowl within crushing recess 44. For example, external surface 24 and crushing recess 44 are both cylindrically shaped such that crushing bowl 20 may be rotated. Similarly, external surface 24 may be circular or dome shaped while crushing recess 44 is a round-shaped depression. Crushing bowl 20 also has a rim 26 which extends beyond crushing recess 44. Rim 26 is configured with ridges 27 which enable a user to easily grasp crushing bowl 20 and rotate crushing bowl 20. Although, rim 26 is shown resting on base 40 around crushing recess 44, rim 26 may also rest above base 40 if crushing bowl 20 has greater length than the depth of crushing recess 44, such that external surface 24 contacts crushing recess 44.

As indicated hereinabove, crushing head 84 and interior surface 24 of crushing bowl 20 are configured to be mated when hammer 80 is in the contact position. Accordingly, crushing head 84 is shown having a generally cylindrical shape with a smaller diameter than the generally cylindrically shaped interior surface 22 of crushing bowl 20. However, crushing head 84 and interior surface 22 may be differently shaped as long as crushing head 84 may be inserted into crushing bowl and urged against tablets 12 placed on interior surface 22 of crushing bowl. Similarly, if a crushing bowl is not utilized, crushing head 84 and crushing recess 44 may also be differently shaped if the crushing head can still be urged against tablets placed in the crushing recess to crush the tablets when pressure is applied. Accordingly, the crushing head may be rectangular while the interior surface of the crushing bowl or the crushing recess is cylindrical.

Crushing head 84 has a crushing surface shown at 86 which is the portion of crushing head 86 urged against crushable tablets 12. Crushing surface 86 is configured with a cross-shaped raised portion 87 and recessed portions 88 between the arms of the cross-shaped raised portion. The pattern of alternating recessed portions 88 and raised portions 87 enables the crushed portions of the tablet to flow into recessed portions 88 as a tablet is crushed. The alternating recessed portions and raised portions can have any pattern or shape. For example, instead of having four raised arms to form a cross-shaped raised portion, the crushing surface may be configured with three or five raised arms or extensions. Alternatively, the crushing surface of the crushing head may be serrated as is the jaw in U.S. Pat. No. 5,178,337, which is hereby incorporated by specific reference, such that the crushing surface has a pattern of alternating raised and recessed portions which are parallel.

The portion of interior surface 22 of crushing bowl 20 against which the pills are crushed is preferably relatively flat as shown at crushing portion 23. Crushing surface 86 of crushing head may also be flat, although, the cross-shaped raised pattern shown in FIG. 1 is preferred. If a crushing bowl is not utilized, then the portion of the crushing recess which receives the pressure as tablets are crushed is similarly preferably flat. In an alternative embodiment, both surfaces crushing the tablets may be complimentarily shaped such that both surfaces are, for example, flat or spherical. More specifically, the crushing portion of the interior surface of the crushing bowl or the crushing recess may be complimentarily shaped with the crushing surface of the crushing head. For example, the crushing head may be rounded such as a pestle while crushing recess is a rounded depression or bowl such as are disclosed in U.S. Pat. No. 4.121,775 and U.S. Pat. No. 4,341,356, which are hereby incorporated by specific reference.

The objective in crushing tablets used as medicaments is to yield a powder which is easily ingested. However, in prior art pill crushers, such as the pill crusher disclosed in U.S. Pat. No. 3,915,393, the crushed tablet tends to form a compressed wedge which is often harder than the pill was originally. In U.S. Pat. No. 3,915,393, the paper cups can be rotated to recrush the wedge, however, the configuration of the surfaces pressing against the tablets repeatedly yields a wedge which flares in height in the direction away from the hinge. As a result, prior art crushers, such as the crusher disclosed in U.S. Pat. No. 3,915,393, may flatten the tablets, however, the tablets are not fragmented.

In the present invention, the formation of tablets into compressed wedges is diminished by directing portions of the crushed tablets into the recessed portions of the crushing surface. As the portions of the crushed tablets flow into the recessed portions, the tablets are fragmented. Accordingly, the alternating pattern of raised and recessed portions 87 and 88 on crushing surface 86 of crushing head provides a significant advantage over the prior art.

Additionally, utilizing a crushing head which is centrally located between the ends of the hammer diminishes the tendency of the crushed tablets to form into wedges as the pressure is exerted relatively even. In contrast, the crushing head disclosed in U.S. Pat. No. 3,915,393 is very near the hinge which results in a relatively uneven application of pressure on the pill to yield wedge shaped lumps of crushed tablets. This configuration also requires significant force from the operator.

While the paper cups disclosed in U.S. Pat. No. 3,915,393 may also be rotated, the configuration disclosed herein eliminates the potential for spilling the crushed tablets. More specifically, as shown in FIG. 5, when hammer 80 is in the contact position and press 90 is in the released position, crushing bowl 20 may be rotated without any possibility of spilling the crushed tablets. The presence of crushing head 84 in crushing bowl 20 and the pressure from the weight of hammer 80 prevents bowl 20 and the sandwich of cups and tablets from being dislodged. Even if a crushing bowl is not utilized, the configuration of hammer 80 and crushing head 84 enable a sandwich of crushed tablets between cups to be rotated without risk of dislodging the crushed tablets out of the crushing recess.

The apparatus disclosed herein provides for the crushed tablet to be fully broken up into a crushed powder in an efficient manner as well as in a secure manner. Rim 26, particularly ridges 27 of rim 26, enable a user to easily grasp and rapidly rotate crushing bowl 20, thereby eliminating the need for fumbling for a delicate pleated paper cup.

Crushing bowl 20 is also provided with a marker 28 so that a user can easily identify a full rotation of crushing bowl 20. The necessity for crushing the tablets at different intervals as crushing bowl 20 is rotated depends primarily on the quantity of tablets and the composition of the tablets. Accordingly, in some instances, one application of pressure may be sufficient while in others it may be necessary to repeatedly apply pressure at several rotation intervals.

However, the efficiency of the crushing process enabled by apparatus 10, primarily results from the configuration of the hammer 80 and press 90. As previously discussed, the configuration of hammer 80 and crushing head 84 enable the tablets to be securely rotated in crushing recess 44 or more specifically crushing bowl 20 in crushing recess 44. After the tablets are rotated, lever 100 can be moved to pivot press 90 from the released position and into the compression position. As shown in FIG. 5, one hand can rotate crushing bowl 20 while the other hand moves lever 100. Accordingly, a user can rapidly rotate and then crush the tablets.

Hammer 80 pivots on a pin 89 which extends through pivot end 81 of hammer 80 and hammer end 41 of base 40. Pin 89 is an example of pivot means for pivotally attaching hammer 80 to hammer end 31 of body 30, more particularly hammer end 41 of base 40. Pin 89 is preferably spring biased with a conventional spring biasing configuration (not shown).

Press 90 also pivots on a pin not shown in FIGS. 1–2 and 4–5. In the embodiment shown in FIGS. 1–2 and 4–5, the pin extends through press 90 and into a recess in top ends 53 and 63 of support arms 50 and 60. A pin 94 may also extend entirely through the top ends as shown in the embodiment depicted in FIG. 3, which has a configuration which is similar to that of pin 89. Such pins are examples of pivot means for pivotally attaching press 90 to press end 33 of body 30, more particularly top ends 53 and 63 of support arms 50 and 60. Additionally, the pin may be an integral pin or two opposing pins extending from press 90. The pin on which press 90 pivots may also be spring biased.

Press 90 has a contact portion 92 configured to press against bearing end 83 of hammer 80 when hammer 80 is in the contact position. The configuration of press 90 enables contact portion 92 to be urged against bearing end 83 of hammer 80 when press 90 is pivoted into a compression position. Pivoting press 90 into a released position moves contact portion 92 upward and out of contact with hammer 80 such that hammer 80 can freely pivot between the loading position and the contact position. In the embodiment shown in FIGS. 1–5, the ability of contact portion to be pressed against bearing end 83 of hammer 80 and to then be moved such that hammer 80 can pivot without contacting press 90 results from the eccentric connection of press 90 to press end 33 of body 30, more specifically to top ends 51 and 61 of support arms 50 and 60. The ability of press 90 to eccentrically pivot is best viewed in FIG. 3 which is a side view of apparatus 10. As discussed above, the apparatus depicted in FIG. 3 is identical to the apparatus depicted in FIGS. 1–2 and 4–5 with the exception of pin 94 which extends through top ends 51 and 61 of support arms 50 and 60.

While the press is preferably essentially circular as is press 90, the press need not be necessarily disk-shaped. The press may also be spherical. Additionally, the press may be asymmetrically shaped such as a press having a perimeter which is pear shaped. Regardless of the shape of the press, the press is preferably connected to the press end of the body at a location near the perimeter of the press such that the press pivots eccentrically. Each press disclosed herein is an example of a press means for pressing against the bearing end of the hammer means.

In addition to the press preferably having a pivot axis which is eccentrically located, the lever preferably extends from the press at a location closer to the pivot axis than contact portion 92. The ability of contact portion 92 of the disk-shaped press 90 to be pressed against bearing end 83 of hammer 80 as press 90 is eccentrically pivoted is enhanced by locating lever 100 in a position relatively close to the pivot pin or pivot axis of press 90. The benefit of locating lever 100 in close proximity to the pivot axis, is particularly realized when the lever is also located such that it is essentially parallel with the longitudinal axis of the hammer when the hammer is in the contact position and the press is in the compression position. Additionally, the ability of a user to apply pressure against bearing end 83 of hammer by moving lever 100 is further enhanced when lever 100 extends eccentrically from press 90 as shown in FIGS. 1–5. In summary, lever 100 is preferably eccentrically connected to press 90 at a location relatively close to the pivot axis of press 90 in a configuration such that lever 100 is essentially parallel with the longitudinal axis of the hammer when the hammer is in the contact position. Each lever disclosed herein is an example of a lever means for moving the press means between the released position and the compression position.

As discussed hereinabove, although, tablets 12 are preferably sandwiched between cups 14 and 16 then placed in crushing bowl 20, tablets 12 may also be crushed directly in crushing recess 44 without crushing bowl 20, tablet cup 14 or crushing cup 16. Accordingly, it should be understood that when reference is made to tablets placed in crushing recess 44 that this includes tablets placed in direct contact with crushing recess 44, tablets in a cup such as medication cup 14 which is in direct contact with crushing recess, or tablets in medication cup 14 positioned in a crushing bowl such as crushing bowl 20 which is disposed in crushing recess 44.

The components may be formed from any suitable materials. Most of the components are preferably formed from aluminum or plastic. It is preferable to avoid pressing aluminum components against other aluminum components. Accordingly, the pivot pins, such as pin 89 and pin 94, as well as press 90 are preferably formed from stainless steel to increase the lifespan of apparatus 10.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for crushing compressible tablets comprising:

a body means for receiving crushable tablets, the body means having a hammer end opposite a press end, the body having a crushing recess between the hammer end and the press end configured to receive crushable tablets;

a hammer means for crushing tablets, the hammer means having a pivot end opposite a bearing end, the pivot end of the hammer means being pivotally connected to the hammer end of the body means, the hammer means being pivotable to a loading position to enable crushable tablets to be loaded into the crushing recess of the body means, the hammer means having a crushing head located between the pivot end and the bearing end of the hammer means, the crushing head being configured for insertion into the crushing recess of the body means when the hammer means is pivoted into a contact position such the crushing head is in contact with crushable tablets placed in the crushing recess, the crushing head being configured for urging against crushable tablets placed in the crushing recess to crush the tablets when sufficient pressure is applied;

a press means for pressing against the bearing end of the hammer means, the press means being pivotally connected to the press end of the body means, the press means having a contact portion configured to press against the bearing end of the hammer means when the hammer means is in the contact position, the press means being configured such that pivoting the press means into a compression position enables the contact portion to be urged against the bearing end of the hammer means and such that pivoting the press means to a released position releases the hammer means to pivot between the loading position and the contact position; and a lever means for moving the press means between the released position and the compression position, the lever means extending from the press means.

2. An apparatus as recited in claim 1, wherein the body means has separate components including a base and two opposing support arms, the base having a hammer end opposite an attachment end, each of the two opposing support arms having a bottom end opposite a top end, the bottom end of each of the two opposing support arms being attached to the attachment end of the base, the top end of each of the two opposing support arms being configured to house an end of a pin extending from the press.

3. An apparatus as recited in claim 2, wherein the base a top and a bottom, and wherein the body further comprises an elongated support member connected to the bottom of the base.

4. An apparatus as recited in claim 3, wherein the elongated support member has a length that is not less than the length of the lever means.

5. An apparatus as recited in claim 1, further comprising a crushing bowl having an exterior surface configured to be positioned in the crushing recess of the body means, an interior surface configured for mating with the crushing head of the hammer means when the hammer means is in the contact position, and a rim which rests above the crushing recess.

6. An apparatus as recited in claim 5, wherein the crushing bowl is a rotatable within the crushing recess.

7. An apparatus as recited in claim 5, wherein the rim is configured to enable a user to easily rotate the crushing bowl.

8. An apparatus as recited in claim 1, wherein the crushing head is generally cylinder shaped.

9. An apparatus as recited in claim 1, wherein the crushing head is approximately centrally located between the pivot end and the bearing end of the hammer means.

10. An apparatus as recited in claim 1, wherein the crushing head has a crushing surface configured with at least one recessed portion and at least one raised portion.

11. An apparatus as recited in claim 1, wherein the crushing head has a crushing surface configured with alternating recessed portions and raised portions.

12. An apparatus as recited in claim 1, wherein the crushing head has a crushing surface configured with a cross-shaped raised portion.

13. An apparatus as recited in claim 1, wherein the crushing head has a crushing surface which is dome shaped.

14. An apparatus as recited in claim 1, wherein the press means is disk-shaped.

15. An apparatus as recited in claim 1, wherein the press means is eccentrically connected to the press end of the body such that the press pivots eccentrically.

16. An apparatus as recited in claim 1, wherein the lever extends eccentrically from the press means.

17. An apparatus as recited in claim 1, wherein the press means has a perimeter, wherein the press means is connected to the press end of the body means at a location near the perimeter of the press means such that the press means pivots eccentrically, wherein the lever means extends from the press means at an eccentric location near the perimeter of the press means.

18. An apparatus as recited in claim 1, wherein the press means has a pivot axis which is eccentrically located with respect to the press means, wherein the lever means extends from the press means at a location closer to the pivot axis than the contact portion.

19. An apparatus for crushing compressible tablets comprising:

a body having a hammer end opposite a press end, the body having a crushing recess between the hammer end and the press end, the crushing recess being configured to receive crushable tablets;

a hammer having a pivot end opposite a bearing end, the pivot end of the hammer being pivotally connected to the hammer end of the body, the hammer being pivotable to a loading position to enable crushable tablets to be loaded into the crushing recess of the body, the hammer having a crushing head located between the pivot end and the bearing end of the hammer, the crushing head being configured for insertion into the crushing recess of the body when the hammer is pivoted into a contact position such the crushing head is in contact with crushable tablets placed in the crushing recess, the crushing head being configured for urging against crushable tablets placed in the crushing recess to crush the tablets when sufficient pressure is applied;

a press pivotally connected to the press end of the body, the press having a contact portion configured to press against the bearing end of the hammer when the hammer is in the contact position, the press being configured such that pivoting the press into a compression position enables the contact portion to be urged against the bearing end of the hammer and such that pivoting the press to a released position releases the hammer to pivot between the loading position and the contact position; and a lever extending from the press to move the press between the released position and the compression position.

20. An apparatus as recited in claim 19, wherein the body has separate components including a base and two opposing support arms, the base having a hammer end opposite an attachment end, each of the two opposing support arms having a bottom end opposite a top end, the bottom end of each of the two opposing support arms being attached to the attachment end of the base, the top end of each of the two opposing support arms being configured to house an end of a pin extending from the press.

21. An apparatus as recited in claim 20, wherein the base a top and a bottom, and wherein the body further comprises an elongated support member connected to the bottom of the base.

22. An apparatus as recited in claim 21, wherein the elongated support member has a length that is not less than the length of the lever.

23. An apparatus as recited in claim 19, further comprising a crushing bowl having an exterior surface configured to be positioned in the crushing recess of the body, an interior surface configured for mating with the crushing head of the hammer when the hammer is in the contact position, and a rim which rests above the crushing recess.

24. An apparatus as recited in claim 23, wherein the crushing bowl is a rotatable within the crushing recess.

25. An apparatus as recited in claim 23, wherein the rim is configured to enable a user to easily rotate the crushing bowl.

26. An apparatus as recited in claim 19, wherein the crushing head is generally cylinder shaped.

27. An apparatus as recited in claim 19, wherein the crushing head is approximately centrally located between the pivot end and the bearing end of the hammer.

28. An apparatus as recited in claim 19, wherein the crushing head has a crushing surface configured with at least one recessed portion and at least one raised portion.

29. An apparatus as recited in claim 19, wherein the crushing head has a crushing surface configured with alternating recessed portions and raised portions.

30. An apparatus as recited in claim 19, wherein the crushing head has a crushing surface configured with a cross-shaped raised portion.

31. An apparatus as recited in claim 19, wherein the crushing head has a crushing surface which is dome shaped.

32. An apparatus as recited in claim 19, wherein the press is disk-shaped.

33. An apparatus as recited in claim 19, wherein the press is eccentrically connected to the press end of the body such that the press pivots eccentrically.

34. An apparatus as recited in claim 19, wherein the lever extends eccentrically from the press.

35. An apparatus as recited in claim 19, wherein the press has a perimeter, wherein the press is connected to the press end of the body at a location near the perimeter of the press such that the press pivots eccentrically, wherein the lever extends from the press at an eccentric location near the perimeter of the press.

36. An apparatus as recited in claim 19, wherein the press has a pivot axis which is eccentrically located with respect to the press, wherein the lever extends from the press at a location closer to the pivot axis than the contact portion.

37. An apparatus for crushing compressible tablets comprising:

a base having a hammer end opposite an attachment end, the base having a crushing recess between the hammer end and the press end;

two opposing support arms having a bottom end opposite a top end, the bottom end of each of the two opposing support arms being attached to the attachment end of the base;

a crushing bowl having an exterior surface configured to be removably and rotatably positioned in the crushing recess of the base, an interior surface configured to receive crushable tablets, and a rim which rests above the crushing recess, a hammer having a pivot end opposite a bearing end, the pivot end of the hammer being pivotally connected to the hammer end of the base, the hammer being pivotable to a loading position to enable crushable tablets to be loaded into the crushing recess of the base, the hammer having a crushing head located between the pivot end and the bearing end of the hammer, the crushing head being configured for insertion into the crushing recess of the base when the hammer is pivoted into a contact position such the crushing head is in contact with crushable tablets placed in the crushing recess, the crushing head being configured for urging against crushable tablets placed in the crushing recess to crush the tablets when sufficient pressure is applied;

a press pivotally connected to the top ends of the two opposing support arms such that the press pivots eccentrically, the press having a contact portion configured to press against the bearing end of the hammer when the hammer is in the contact position, the press being configured such that pivoting the press into a compression position enables the contact portion to be urged against the bearing end of the hammer and such that pivoting the press to a released position releases the hammer to pivot between the loading position and the contact position; and a lever extending from the press to move the press between the released position and the compression position.

38. An apparatus as recited in claim 37, wherein the base has a top and a bottom, and further comprising an elongated support member connected to the bottom of the base.

39. An apparatus as recited in claim 38, wherein the elongated support member has a length that is not less than the length of the lever.

40. An apparatus as recited in claim 37, wherein the rim is configured to enable a user to easily rotate the crushing bowl.

41. An apparatus as recited in claim 37, wherein the crushing head is generally cylinder shaped.

42. An apparatus as recited in claim 37, wherein the crushing head is approximately centrally located between the pivot end and the bearing end of the hammer.

43. An apparatus as recited in claim 37, wherein the crushing head has a crushing surface configured with at least one recessed portion and at least one raised portion.

44. An apparatus as recited in claim 37, wherein the crushing head has a crushing surface configured with alternating recessed portions and raised portions.

45. An apparatus as recited in claim 37, wherein the crushing head has a crushing surface configured with a cross-shaped raised portion.

46. An apparatus as recited in claim 37, wherein the crushing head has a crushing surface which is dome shaped.

47. An apparatus as recited in claim 37, wherein the press is disk-shaped.

48. An apparatus as recited in claim 37, wherein the lever extends eccentrically from the press.

49. An apparatus as recited in claim 37, wherein the press has a pivot axis and wherein the lever extends from the press at a location closer to the pivot axis than the contact portion.

* * * * *